United States Patent [19]

Rennie

[11] Patent Number: 4,567,675

[45] Date of Patent: Feb. 4, 1986

[54] DEVICE FOR CONDITIONING FABRICS IN A TUMBLE-DRYER

[75] Inventor: George K. Rennie, Wirral, England

[73] Assignee: Lever Brothers Company, New York, N.Y.

[21] Appl. No.: 494,143

[22] Filed: May 12, 1983

[30] Foreign Application Priority Data

May 20, 1982 [GB] United Kingdom ..... 8214789

[51] Int. Cl.[4] ..... F26B 19/00

[52] U.S. Cl. ..... 34/60; 134/12; 206/0.5; 206/524.6

[58] Field of Search ..... 34/12, 60; 206/0.5, 206/524.6; 252/8.6, 8.8

[56] References Cited

U.S. PATENT DOCUMENTS

| | | | |
|---|---|---|---|
| 3,138,432 | 6/1964 | Kleinhans | 206/0.5 |
| 3,706,140 | 12/1972 | Brillaud et al. . | |
| 3,948,387 | 4/1976 | Haertle . | |
| 4,014,105 | 3/1977 | Furgal et al. | 34/12 |
| 4,114,284 | 9/1978 | Weber et al. | 34/12 |

FOREIGN PATENT DOCUMENTS

| | | |
|---|---|---|
| 52813 | 3/1973 | Australia . |
| 28380 | 10/1980 | European Pat. Off. . |
| 2635256 | 2/1978 | Fed. Rep. of Germany . |
| 2088401 | 1/1972 | France . |
| 172845 | 9/1975 | New Zealand . |
| 1313697 | 4/1973 | United Kingdom . |
| 1383749 | 2/1975 | United Kingdom . |
| 1399728 | 7/1975 | United Kingdom . |
| 1542456 | 3/1979 | United Kingdom . |
| 1546763 | 5/1979 | United Kingdom . |
| 1549432 | 8/1979 | United Kingdom . |
| 1565907 | 4/1980 | United Kingdom . |
| 1577694 | 10/1980 | United Kingdom . |
| 1578951 | 11/1980 | United Kingdom . |
| 1587650 | 4/1981 | United Kingdom . |
| 2069020 | 6/1983 | United Kingdom . |

*Primary Examiner*—Larry I. Schwartz
*Assistant Examiner*—David W. Westphal
*Attorney, Agent, or Firm*—Milton L. Honig; James J. Farrell

[57] ABSTRACT

A device for conditioning fabrics in the tumble-dryer comprises a powdered conditioning agent inside a permeable container, for example a sachet of paper, non-woven fabric or plastics film, which in turn is inside an outer, substantially form-retaining, apertured container. The outer container is of a shape, for example, spherical, which allows ready movement among the tumbled fabrics. As it moves, the article gives more uniform and efficient conditioning than articles in the form of a sheet substrate impregnated with a solid conditioning agent.

24 Claims, 11 Drawing Figures

Fig. 7.
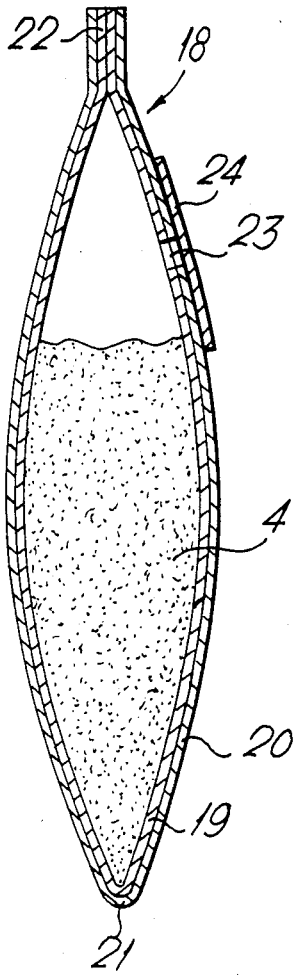
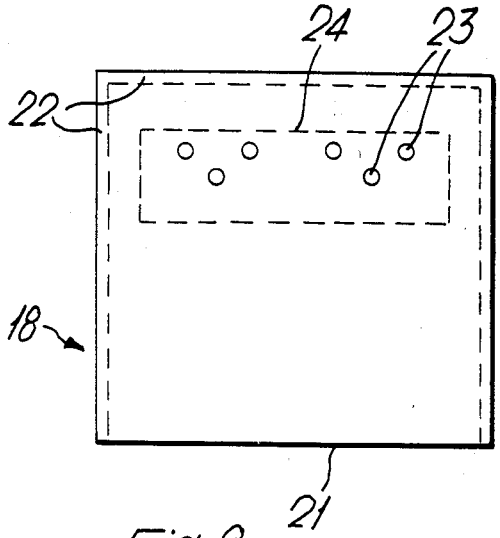
Fig. 8.

Fig. 9.
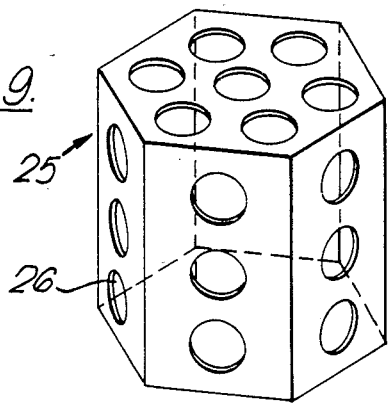
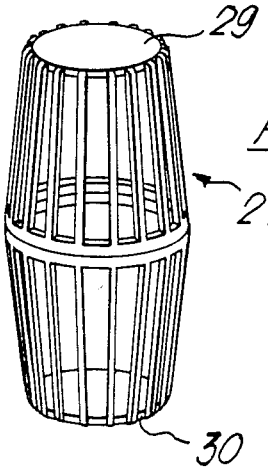
Fig. 10.
Fig. 11.
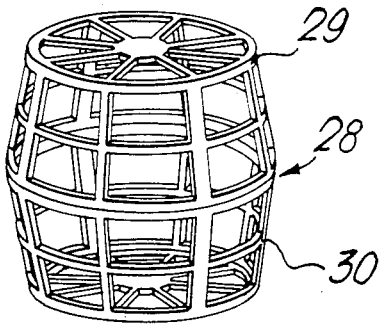

DEVICE FOR CONDITIONING FABRICS IN A TUMBLE-DRYER

The present invention relates to a device for conditioning fabrics in a tumble-dryer. The term "conditioning" is used here to mean the imparting of any consumer benefit such as softness, anti-static, perfume, crease-resistance, or easy ironability.

Since the advent of rinse conditioners on the retail market, consumers have come to expect fabrics emerging from the home laundry process to possess a certain level of softness, anti-static and perfume. When the whole wash cycle is carried out in an automatic washing machine, however, it may not be convenient or even possible to add rinse conditioner at the final rinse stage. Attempts have therefore been made to deliver a benefit comparable to that obtained by the use of rinse conditioners, by adding fabric conditioner after the completion of the washing machine cycle, while the fabrics are drying in a tumble-dryer.

Tumble-drying in itself imparts a certain softening effect as compared with line-drying, but the problem of the build-up of electrostatic charge, which is particularly severe with modern synthetic fibres, is aggravated. Thus while a softener in the narrowest sense may be unnecessary for tumble-dried fabrics, conditioning in the broader sense is still highly desirable.

U.S. Pat. No. 3,442,692 (Gaiser) discloses the method of conditioning washed fabrics during drying in a tumble-dryer, wherein a fabric conditioning agent is carried on a sheet substrate, such as a conventional paper towel, which is tumbled with the fabrics. The sheet substrate is impregnated with the conditioning agent.

Since the publication of the Gaiser patent a myriad of patents and applications relating to variants and improvements of this concept has appeared. U.S. Pat. No. 3,686,025 (Procter & Gamble) is representative of this art. There have also been proposed articles of this type based on a solid block or bar of conditioning agent rather than an impregnated sheet; see, for example, U.S. Pat. No. 4,098,937 (Economics Laboratory) and U.S. Pat. No. 3,948,387 (Kleen Test Products Inc.). Devices based on the use of a liquid conditioning agent have also been described. For example, GB No. 1 373 952 (Colgate) discloses a container of liquid conditioner which can be attached to the dryer drum. The container is provided with fluid discharge apertures and is covered with a layer of felt or similar material to act as a distributing surface.

GB No. 1 383 749 (Colgate) discloses a laundry conditioning article comprising an inherently form-retaining base of such shape as to be readily tumbled with the laundry in a dryer, with a conditioning agent (solid or liquid) on an external surface of the base or contained therein. The base may, for example, be spherical in shape. One embodiment described is a solid sphere of polystyrene foam coated with a solid conditioning agent which is gradually rubbed off on coming into contact with the fabric load in the dryer. An alternative embodiment is in the form of a hollow apertured sphere, for example of polyethylene or polypropylene, in two halves which can be screwed together; the sphere contains a liquid conditioning agent. To prevent leakage of the liquid when the article is stationary, the lower part of the sphere is either without apertures or has only very small ones.

GB No. 1 578 951 (Procter & Gamble) discloses a fabric conditioning article in the form of a closed flexible receptacle containing a granular conditioning agent. The particle size of the latter is preferably within the 40–120 μm range. At least one wall of the flexible receptacle is of a double-layered porous material and in use, in the washing machine or tumble dryer, the granular conditioning agent is dispersed through that wall.

GB No. 1 587 650 (Procter & Gamble) discloses a fabric conditioning article, having inner and outer receptacles, that is designed to be placed in the washing machine together with the fabrics to be washed, and to remain with the fabrics throughout the wash, rinse and drying cycles. The inner receptacle contains a fabric conditioner, and the outer receptacle contains an electrolyte or pH control agent that temporarily insolubilises the wall of the inner receptacle, and thus prevents release of the fabric conditioner, until the rinse or drying stage is reached.

The subject of the present invention is an improved fabric conditioning device based on a fabric conditioning agent in powder form.

The present invention accordingly provides a device for conditioning fabrics in a dryer, which device comprises a fabric conditioning composition in free-flowing powder form disposed within a first container of material permeable to said composition in powder form, the first container being disposed within a second container having openings for the egress of said composition in powder form, the second container being substantially form-retaining and of a shape such as to allow ready movement thereof among the fabrics in a dryer.

The device of the invention possesses substantial advantages over previously proposed impregnated sheet substrate devices.

When a conditioning article of the impregnated sheet substrate type as disclosed in U.S. Pat. No. 3,442,692 (Gaiser) comes into contact with a fabric in the tumble-dryer, conditioning agent is deposited locally, on the area of actual contact only. The deposition of conditioner is thus non-uniform. If the fabric has an upstanding pile, as does terry towelling, deposition occurs virtually exclusively on the pile. Both these effects can be demonstrated, in the case of a cationic conditioner, using an indicator dye such as bromophenol blue.

Furthermore, the sheet substrate type of article can easily become rolled and twisted among the fabrics and hence caught in contact with a relatively small proportion of the total load; these areas of fabric will then become overloaded with conditioner while other areas of the load will not be conditioned at all. Overloading of conditioner in particular areas of fabric leads to spotting and staining.

The device of the invention, however, conditions fabrics by scattering on them a fabric conditioning agent in free-flowing powder form. The powdered conditioning agent in its primary permeable container is protected from direct contact with the damp fabrics and with water droplets by the second (outer) container, so that clogging cannot occur. The second container also helps to reduce the incidence of local overloading of conditioner, and hence spotting and staining. The powdered conditioner is scattered, as from a pepper-pot or sugar sifter, as the second container moves among the fabrics. The particles initially adhere to the damp fabrics and then spread to cover the fabrics wholly or partially.

For convenience and clarity the first container will hereinafter be referred to as the inner container, and the second container as the outer container.

It is an essential feature of the present invention that the fabric conditioning agent be in the form of a free-flowing powder. The smaller the particle size of the powder, the greater the uniformity of its distribution on the fabrics in the dryer; but a particle size smaller than 20 μm is undesirable on safety grounds because of its respirability. Particle sizes above 1000 μm have generally been found to give insufficiently uniform conditioning unless very high loadings are used. The optimum particle size range appears to be 70 to 500 μm, the range of 90 to 250 μm being especially effective. The pile spacing of terry towelling is approximately 250 μm, so a particle size smaller than that is desirable in order to ensure penetration of the powder onto the base fabric so that the whole fabric, not just the upstanding pile, is conditioned.

The powder should all be dispersed onto the fabrics while the fabrics are still damp enough for the powder to adhere to them. The time over which the powder should be dispensed accordingly depends on the fabric load and its initial water content, as well as on the tumble dryer itself. For UK or European tumble dryers it has been found that the powder should preferably be dispensed over a period of at least 2.5 minutes and not exceeding 20 minutes, preferably not exceeding 10 minutes. The time period over which the powder is dispensed may be controlled by suitable choice of the number of holes in the inner container as well as their size.

The inner container is formed at least partially of material that is permeable to the powdered conditioning agent by way of a suitable number of suitably sized holes. Since it is protected by the outer container there is no need for the inner container to be form-retaining or of suitable shape for ready tumbling among the fabrics. The hole size of the inner container is advantageously matched to the particle size of the powdered conditioning agent, so that the latter is dispensed in a controlled manner. For example, if the particle size is within the preferred range of 70 to 500 μm, the inner container is advantageously substantially free of openings larger than 2000 μm, and more preferably substantially free of openings larger than 1000 μm. Use of an inner container having a hole size approximately equal to the largest particle size of the powder used gives especially uniform conditioning. Some powders may, however, have a tendency to agglomerate under tumble-dryer conditions to form larger particles and in this case the openings must be sufficiently large to accommodate the agglomerate.

In a preferred embodiment of the invention, the inner container is a sachet of flexible sheet material provided over part or whole of its surface with openings to provide permeability to the powder. Suitable materials include paper, nonwoven fabrics, plastics films, and laminates of these. If desired, one or more sachet walls may be constituted by a material provided with openings uniformly over its whole surface, an example of a highly suitable material of this type is the paper used to make tea and coffee bags, which generally has a pore size of about 250 μm. This is highly suitable for dispensing powders having a particle size of less than 250 μm, and it will be remembered that such powders are of particular advantage in the conditioning of terry towelling, which has a pile spacing of approximately 250 μm.

Alternatively an essentially non-porous material may be used and provided with a chosen number of perforations of a chosen size in a chosen arrangement; this second possibility is preferred when relatively large, for example, 2000 μm, openings are required.

Of course other, more elaborate types of inner container may also be used; for example, the inner container might simply be a scaled-down version of the outer container, preferred forms of which are described below. The inner container may be either rigid or flexible, but, as discussed in more detail below, if free to move around in the outer container it is preferably flexible.

The inner container should be of sufficiently large size to contain an appropriate quantity of conditioning agent and to deliver it at an appropriate rate, but small enough to be fitted into the outer container. For economy of material it is desirably as small as possible, but if it is too tightly packed the motion of the powder is restricted and its rate of delivery reduced. Depending on the fabric conditioner used and thus on the quantity required, a sachet the size of a one-cup tea bag (4 cm×4 cm or 4 cm×6 cm) or one the size of a large tea bag (8 cm×6 cm) is likely to be suitable.

The outer container is substantially form-retaining, but is preferably not completely rigid. The container should not be significantly deformed by the tumbling fabrics as it moves among them, but it should be to some extent energy-absorbing, and thus sound-absorbing, so that the noise it makes on impact with the drum is not excessive, thus some flexing of the container walls is desirable.

The shape and size of the outer container should be such that it moves freely among the fabric load under the motion of the dryer and distributes its contents as uniformly as possible. The outer surface should be as smoothly contoured as possible, and free of protrusions and sharp edges that can catch on the fabrics. In principle any shape is suitable provided that angles between adjacent faces are not too small; any edges and corners are advantageously rounded off. The ratio of the principal axes (major to minor) is preferably not greater than 5:1, and is advantageously 2:1 or less, a ratio of approximately 1:1 being especially preferred.

The ideal shape appears to be spherical or substantially spherical, and spheroidal, ellipsoidal, cylindrical and frustoconical shapes are also highly advantageous. Other shapes of interest include cubes, hexagonal prisms, and pairs of frustocones abutting at their larger ends, and other possible shapes will readily suggest themselves to one skilled in the art.

It has been found experimentally that, when using UK or European tumble-dryers, the largest dimension of the outer container is preferably at least 6 cm. Smaller containers tend to become caught among the fabrics.

The outer container can be of any reasonable mass, but should not be too heavy, otherwise damage to the dryer could result.

Of course the material of the outer container must be relatively robust, as it will be knocked frequently against the walls of the dryer and compressed by the fabrics. It must also be stable at the temperatures encountered in the dryer, which generally should not exceed 70° C. but may rise to 100° C. or above in old or poorly maintained machines. Accordingly the material of the outer container is preferably stable at temperatures up to at least 130° C., and preferably up to about 170° C.

Suitable materials include thermoplastic and thermosetting resins, wood, resin-bonded cardboard, papier-mâché and casein, natural and synthetic rubbers, and lightweight metals, for example aluminium. Materials that are unsuitable for contact with wet fabrics, for example cardboard, may be protected by a coating of, for example, rubber or plastics material or metal foil. Many other lightweight, robust and heat-stable materials will readily suggest themselves to the skilled worker in the art.

Thermoplastic materials of sufficiently high softening point (preferably above 130° C.) and robustness offer manufacturing advantages in that suitable shapes can readily be made by moulding techniques such as injection, extrusion or blow-moulding. Preferred materials include polystyrene, high-density polyethylene and, in particular, polypropylene. The softening point of the last-mentioned material is above 130°.

The outer container is provided with openings, for example, slits or circular holes, through which the powdered conditioning agent passes. These are larger than the openings in the inner container (see below) so that they provide no impedance to the passage of the powdered conditioning agent. Preferably the total area of the openings in the outer container is at least 3 times as large as the total area of the openings in the inner container, and advantageously at least 5 times as large. The individual openings are desirably as large as possible provided that the inner container cannot fall out and the outer container has sufficient integrity and robustness. The shape of the openings is not important as far as delivery of the powder is concerned, but may have some influence on the strength and flexibility of the outer container and its noisiness in use. It has been found, for example, that in the case of a spherical polypropylene container the use of elongate slits rather than circular holes gives substantially less noise in use, presumably because of greater flexibility.

Optionally the surfaces of the outer container, especially the inner surface and the edges of the openings, may be rendered to some extent hydrophobic (if not inherently so) to prevent or reduce the penetration into its interior of water droplets, which may collect on the outer surface at an early stage in the dryer cycle.

The interior of the outer container may optionally be provided with means for keeping the inner container at a distance from its outer wall(s) and thus ensuring that no direct contact with damp fabrics or water droplets occurs. The inner wall(s) may, for example, be provided with protrusions which act as spacers. Alternatively, locating means, such as pins or pegs, may be provided to hold the inner container in a fixed position; this measure has the advantage that in the case of a flexible inner container such as a sachet the latter is prevented from becoming crumpled up. Where the outer container is injection-moulded, such pins or pegs may readily be formed as an integral part of it. Spacer ribs or other protrusions as mentioned above may also easily be formed in this way.

As mentioned previously, the inner container may be rigid or flexible but if free to move around in the outer container is preferably flexible. This is for noise reasons. If, however, locating means as described in the previous paragraph are provided in the outer container, a rigid inner container may if desired be used without creating a noise problem.

Advantageously the outer container is sufficiently robust to be reusable, and is so constructed that an inner container may readily be inserted or removed. Thus multiple use of the outer container with a succession of inner containers is possible. Furthermore two inner containers may be used at once if a particularly large load is contemplated. The outer container may, for example be so designed that, by flexing, one of its apertures may be enlarged to a sufficient extent that an inner container can be inserted or removed. More conveniently, the outer container may be constructed in two or more parts that can readily be separated and rejoined. The parts may if desired be connected by a hinge or the like so that they never become completely separated. The parts should join up by a mechanism that leaves the outer surface of the closed container as smooth as possible, and that will not accidentally come open during use in the tumble-dryer. Examples of suitable mechanisms include snap-fit, a lock screw, and internal hooks joined by elastic.

If a succession of inner containers is to be used with the same outer container, it may be unnecessary to remove the spent inner containers before inserting a new one, if the inner containers are of a type, for example, a flexible sachet, that once empty occupies little space. In practice it has been found that ten sachets may be used successively within a slitted polypropylene sphere without removing the empty sachets.

In this preferred embodiment of the invention where the outer container is reusable and full inner containers are separately available as refills, it is clearly desirable for these inner containers to be provided with outer packaging or covering in order to prevent premature discharge of their contents. The outer packaging or covering is advantageously also moisture-proof in order to protect the powdered conditioning agent from atmospheric moisture during storage and handling prior to use.

It is essential that such outer packaging or covering be in intimate contact with all surface regions of the inner container that are permeable to the powdered conditioning agent. If space is left between the two, powder will escape into that space and will be lost when the outer packaging or covering is removed.

The outer packaging or covering is thus preferably a flexible sheet material that can be made to conform intimately and accurately to any permeable surface region of the inner container.

Any film or sheet that can be made to adhere to the inner container and subsequently removed is in principle suitable, the choice of material depending among other things on the material used for the inner container itself and the area required to be covered.

In the case of a tea-bag-like sachet where a relatively large area of the sachet, possibly the whole of it, is powder-permeable and needs an outer covering, the outer covering is preferably a relatively durable material impermeable to moisture and perfume so that the product has a reasonable storage life. Materials that can be heat-sealed, either inherently or with the aid of hot-melt adhesives, are especially advantageous.

Plastic films may be suitable, but thin films of the ∓clingfilm" type (polyvinylidene chloride) that depend on static electrical attraction for adhesion will only be effective if the powdered conditioning agent does not include an anti-static agent. Other plastic films that do not depend on static attraction may, however, be suitable under those circumstances. Examples include Nescofilm (Trade Mark), a plasticised polyethylene film, and Parafilm (Trade Mark), a paraffin-wax-coated packaging film.

Preferably, however, the outer covering includes or consists of a metal foil, aluminium foil being especially preferred because it is non-stretching, readily laminated, readily removable, and provides a moisture-proof outer layer which also prevents or reduces perfume loss during storage. Advantageously the foil may be laminated to an outer layer of paper, so that a very thin layer of the relatively expensive foil may be used.

Some other composite materials may also combine the desired properties. For example, metallised thermoplastic (for example, polyester) film can conveniently combine moisture-impermeability and heat-sealability. Paper itself is not ideal because of its inadequate resistance to moisture, but paper coated or laminated with wax or plastics material can be highly suitable.

For example, a sachet may conveniently be formed of a laminate of metal foil/paper or paper/metal foil/paper, the term paper here being used to include nonwoven fabric. One side of the sachet may for example be of powder-permeable paper or nonwoven fabric, for example teabag paper, laminated onto metal foil, optionally with a further outer layer of paper, and the other of impermeable material (metal foil alone, impermeable paper or nonwoven fabric alone, or a laminate). The bonding between the various layers is preferably by means of heat-sealing, using small amounts of hot-melt adhesive. The bonding between the metal foil and the permeable material is deliberately weak so that the outer (foil) layer can be peeled off immediately prior to insertion in the outer container and use.

The above discussion relates to the situation where the inner container needs to be totally or nearly totally enclosed by the outer packaging. In the case of an inner container which itself consists mainly of moistureproof, relatively durable, powder-impermeable material and which has openings localised over a relatively small area, it is clearly necessary only to cover that area itself, so that the outer packaging or covering will be small compared to the overall size of the inner container and will not be subject to such stringent requirements as regards durability and impermeability to moisture and perfume. A label or tag coated with a pressure-sensitive adhesive may be sufficient in these circumstances; this may be of any of the materials already mentioned, if desired, but paper alone may be adequate for a label or tag of relatively small area.

An example of an inner container of this type is a sachet of plastics film, for example, polyethylene having a small number of perforations positioned relatively closely together in one wall only. An adhesive-coated label of strong paper may be used to cover just the perforated region. A problem with this type of sachet arises from the low adhesiveness of plastics film, so that the label may be detached prematurely during transit or storage. This problem may be alleviated by subjecting the plastics film to a suitable surface treatment or, preferably, making the entire sachet, or the perforated wall, of a laminate of the plastics film with paper or nonwoven fabric, the latter layer being outermost. This is another example of a composite material that combines desired properties.

Many other materials and constructions are of course possible for the inner container and will readily suggest themselves to one skilled in the art.

The fabric conditioning composition used in the device of the invention can include any material which imparts to fabrics any consumer benefit, for example, softness, anti-static properties, perfume, crease-resistance or easy-iron characteristics, or any combination of these. It is essential that the composition be in free-flowing powder form, in order that it can be delivered by the device of the invention. It is furthermore essential for effective conditioning that the powder, once scattered onto the damp fabrics, will during the drying cycle form a fluid or gel phase and spread over the fabrics before drying. This gel formation may be by way of melting, dissolution, dispersion or any combination of these mechanisms. It thus follows that the composition desirably either melts at the temperatures prevailing in the later part of the drying cycle, or has an affinity for water at these temperatures such that efficient spreading will occur by means of normal or colloidal dissolution or dispersion; or exhibits a combination of these properties. Such melting, dissolution or other spreading mechanism should not, however, take effect while the powder is still inside the dispensing device, otherwise clogging may occur and effective delivery be prevented. As previously indicated, however, powders that have a tendency under the conditions prevailing in the early part of the dryer cycle to agglomerate to form larger particles are still usable in the device of the invention, provided that the hole size of the inner container is chosen to suit the agglomerate.

In terms of melting point, there is an additional constraint that a material that melts at too low a temperature will melt while still in the inner container and will not be delivered. Thus it is generally true that powders melting below about 50° C. are not suitable for use in the device of the present invention.

If fabric conditioning agents having these various prerequisites are used, the composition may consist wholly of such ingredients that contribute actively to fabric conditioning. Other conditioning agents, for example, those not available as free-flowing powders, having too high or too low melting points or too low solubilities, may nevertheless be used in the device of the invention if they are combined with adjunct materials that improve these properties.

The three benefits currently most sought after by the consumer are softening, elimination of static cling and perfume. As indicated previously, the tumble-drying process itself imparts some softness to the fabrics, but this is less than the softness resulting from the use of a rinse conditioner; additional softening is thus desirable. Softening agents known in the art include substantially water-insoluble surfactants, especially nonionic and cationic surfactants.

The build-up of electrostatic charge is a particular problem with tumble-dried fabrics, especially those based on synthetic fibres. Antistatic benefits may be obtained from the use of charge-carrying materials, especially ionic compounds.

As is well known in the art, cationic surfactants combine anti-static and softening benefits and are widely used in both rinse conditioners and tumble-dryer products. Many suitable materials are, for example, disclosed in the aforementioned U.S. Pat. No. 3,686,025 (Procter & Gamble).

The powdered conditioning composition in the device of the invention thus advantageously contains inter alia a cationic fabric conditioner which is advantageously a quaternary ammonium salt. Fabric-substantive compounds of this general class containing two long-chain alkyl groups and two lower alkyl groups, for example, di(hardened tallow alkyl)dimethyl ammonium chloride or methosulphate, are especially preferred. One suitable material is Arosurf (Trade Mark) TA 100 ex Ashland Chemical Company, which is a dry, free-flowing 95% active form of distearyl dimethyl ammonium chloride.

This material is a highly effective softener and anti-static agent. It is relatively insoluble in water and melts at about 65° C. and when used in the device of the invention in the high-temperature drying cycle of a tumble-dryer spreads on the fabrics by a melting mechanism. Because of its relatively high melting point it is unsuitable for use alone in a low-temperature drying cycle, but its melting point can be lowered to about 55° C. by the admixture of, for example, glyceryl monostearate.

Arosurf TA 100 is an example of a fabric-substantive conditioning agent. It is not, however essential that the conditioning agent used in the device of the invention be fabric-substantive, unlike those used in rinse conditioners, because the fabrics are not wetted again after the application of the conditioning agent.

The conditioning composition may advantageously contain a perfume, which is preferably fabric-substantive. If the outer covering of the sachet is of a material such as aluminium foil perfume loss is prevented by the outer covering and the perfume may be incorporated by any simple method such as dry dosing. If the outer covering is of a material that will now prevent loss of perfume, the perfume may be protected by encapsulation or the like.

The free flow properties of the powdered conditioning composition can if desired by improved by the addition of small amounts (not more than 10% w/w) of inorganic free flow agents such as Aerosil (Trade Mark), a silica aerogel available from Degussa AG, Germany, Microsil (Trade Mark), a precipitated silica available from J Crosfield & Son Ltd, UK, or various other silicas and insoluble silicates.

The amount of conditioning composition present in the inner container will, of course, depend on the nature of the conditioning agent, but in general loadings of 0.5 to 12 g, preferably 1.5 to 10 g, more preferably 2.5 to 7 g, have been found to give good conditioning results with a single dryer load.

The invention will now be described in further detail, by way of example only, with reference to the accompanying drawings, in which:

FIG. 7 is a sectional view, on an enlarged scale, of an alternative inner container for use in a device according to he invention;

FIG. 8 is a plan view, of approximately actual size, of the inner container of FIG. 7; and FIGS. 9, 10 and 11 are perspective views of alternative outer containers for use in devices according to the invention.

Figure 1:
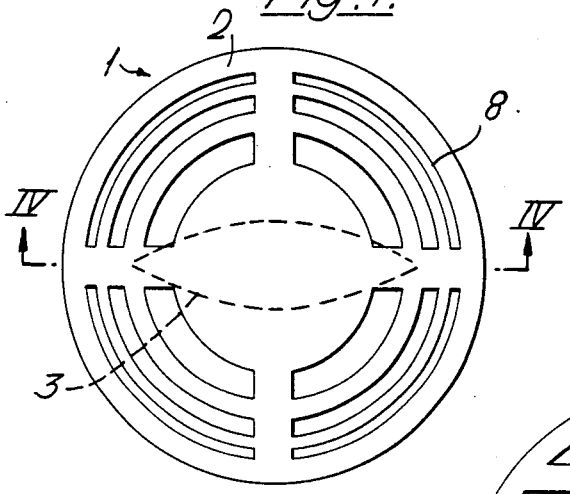
FIG. 1 is a plan view of a device of the invention.
Figure 2:
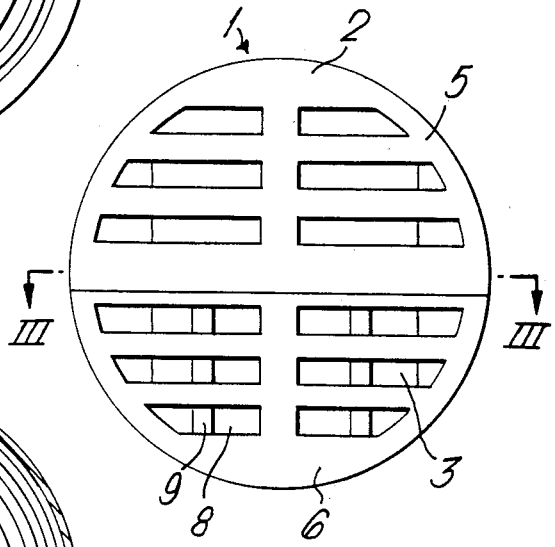
FIG. 2 is an elevation of the device.
Figure 3:
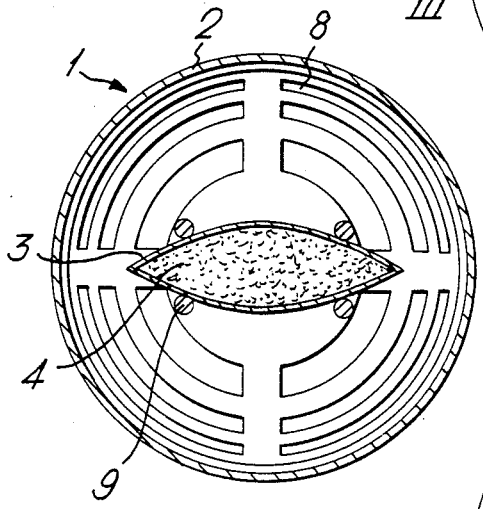
FIG. 3 is a horizontal section, taken along the line III—III of FIG. 2.
Figure 4:
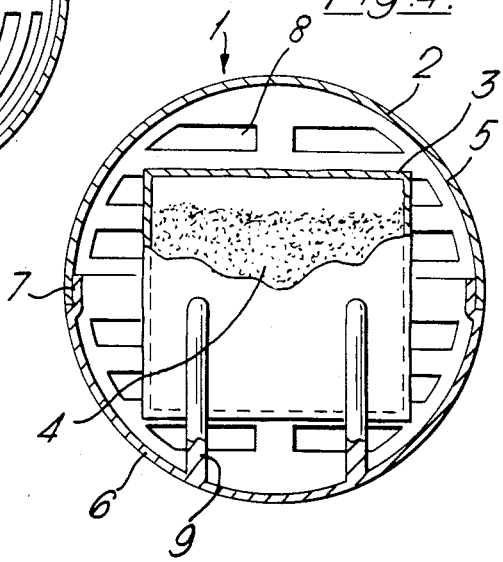
FIG. 4 is a vertical section, taken along the line IV—IV of FIG. 1.

Referring now to FIGS. 1 to 4 of the accompanying drawings, a device 1 according to the invention consists of outer container 2, and an inner container 3 containing a powdered fabric conditioning agent 4.

The outer container 2 is a hollow polypropylene sphere having a diameter of at least 6 cm, for example, 9 cm, and consisting of upper and lower hemispheres 5 and 6 fitted together by means of a firm snap-fit arrangement 7 such that the outer surface is smooth. Both hemispheres are provided with a plurality of parallel slits 8 each having a width of about 2 to 3 mm. The lower hemisphere 6 includes four integral pins 9 which extend upwardly from its base.

Wedged between the pins 9 is the inner container 3 which is a sachet of flexible porous web material of a size, for example 4 cm×4 cm, such that when wedged firmly between the pins 9 it is spaced from each wall of the sphere 2. The sachet 3 contains a powdered fabric conditioning composition milled to a particle size of 180–250 μm.

The consumer may initially be supplied, for example, with one sphere 2 and a plurality of sachets 3.

Figure 5:
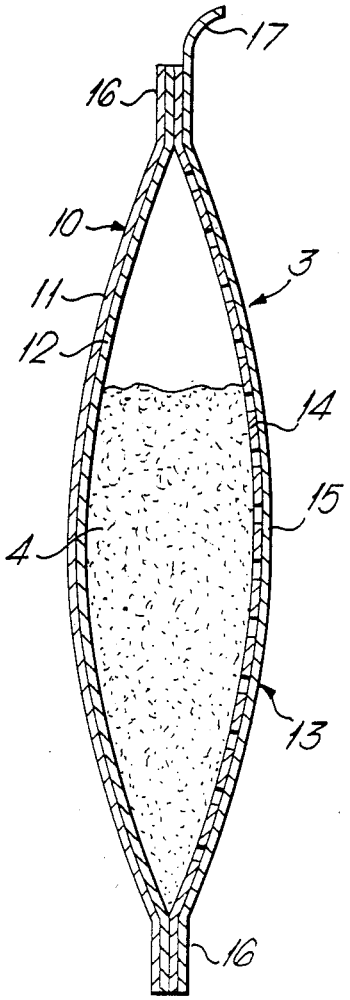
FIGS. 5 and 6 are sectional views, on an enlarged scale, of part of the device of FIGS. 1 to 4.

The sachet 3 as initially supplied to the consumer is shown in FIG. 5. A first wall 10 of the sachet 3 is of material impermeable to the powdered fabric conditioning composition 4, and consists of an outer layer 11 of aluminium foil laminated to an inner layer 12 of paper. The foil layer 11 can be very thin as it is supported and reinforced by the paper layer 12. A second wall 13 of the sachet also consists of a laminate, its inner layer 14 being of porous paper, of pore size approximately 250 μm, as used for tea and coffee bags, and its outer layer 15 being of aluminium foil. If desired an additional layer of paper (not shown) could be laminated to the outer side of one or both of the foil layers 11 and 15. This would allow even thinner layers of foil to be used. The thicknesses of all four layers shown in FIGS. 5 and 6 have of course been greatly exaggerated in for the sake of clarity.

The layers are bonded together at their edge regions 16 by means of heat-sealing, a small amount of hot-melt adhesive having been provided there for that purpose. The bond between the paper layers 12 and 14 are relatively strong whereas the bonds between the aluminium layers 11 and 15 and the paper layers 12 and 14 respectively are relatively weak, because of the inherently lower adhesion of aluminium. An end region 17 of the layer 15 extends beyond one region of sealing to form a pull-tab for the consumer.

It will be noted that the sachet 3 as shown in FIG. 5 is entirely covered with aluminium foil and its contents 4 are thus protected from atmospheric moisture; any perfume present in the composition 4 is also retained.

Figure 6:
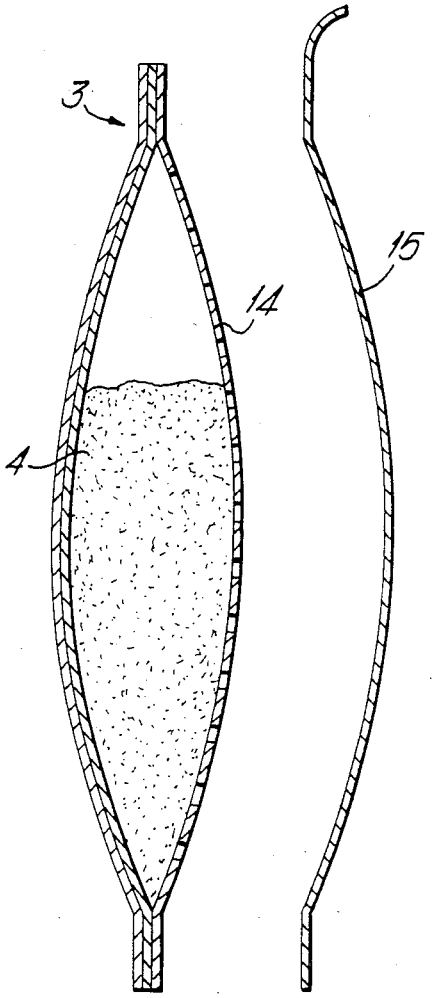

Immediately prior to use, the consumer grasps the pull tab 17 and removes the layer 15, thus exposing the permeable layer 14, as shown in FIG. 6. The layer 15 comes away easily without tearing the layer 14 or opening the seals between the other layers, because, as previously mentioned, it is bonded relatively weakly to the other parts of the sachet. The layer 15 can then be discarded and the sachet 3 is ready for use. Although the bond between the layers 11 and 12 is also relatively weak, the aluminium layer 11 does not in general come off because no pull-tab or other starting device is provided.

The consumer then snaps apart the sphere 2, wedges the sachet between the pins 9, and snaps the sphere together again. The device is now ready for use in a tumble-dryer.

FIGS. 7 and 8 show an alternative form of sachet suitable for use in the present invention. The sachet 18, shown in FIG. 8 at approximately its actual size and in FIG. 7 at an enlarged scale corresponding to that of FIGS. 5 and 6, is formed of a laminate of polyethylene film 19 and paper 20, the film 19 being innermost. As shown, the sachet 18 is composed of a single sheet of laminate, one edge 21 being constituted by a fold and the other edges 22 being closed by heat-sealing; alternatively, two sheets could have been used and all four edges closed by heat-sealing. Holes 23 of approximately 2 mm (2000 μm) diameter have been punched in one wall of the sachet, the number of holes and their size having been chosen to give an appropriate delivery rate for the powder 4. The holes 23 are positioned relatively closely together so as to occupy a relatively small area of the sachet wall. An adhesive label 24, indicated in FIG. 8 by a dotted line, covers the region occupied by the holes; it adheres without difficulty to the paper of the outer sachet wall, but can readily be removed by the consumer immediately prior to use.

FIGS. 9, 10 and 11 show alternative forms of outer container for use in the device of the present invention. The container 25 of FIG. 9 is in the shape of a hexagonal prism having an aspect ratio (ratio of major axis to minor axis) of about 1:1, formed of folded resin-bonded cardboard, and having relatively large circular openings 26.

FIGS. 10 and 11 show two containers 27 and 28 of injection-moulded plastics material, each in the shape of two abutting frustocones, the containers 27 and 28 having aspect ratios of about 2:1 and about 1.5:1 respectively. Each can be separated into upper and lower parts 29 and 30 connected only by a small integral "hinge" (not shown), for insertion of an inner container, and the two parts can then be snap-fitted together.

The invention is further illustrated by the following non-limiting Examples.

EXAMPLES 1 TO 5

The following experiment was carried out in order to compare the softness delivered by the device of the invention with that delivered by three control systems.

Batches of 2 kg of desized terry towelling, each containing twelve pieces each about 18×20 cm, were washed at 95° C. under typical UK conditions, in a Hoover (Trade Mark) Electronic 1100 washing machine with Persil (Trade Mark) Automatic powder (120 g) and London water (24° French hardness). Each batch was then tumble-dried in a Bendix (Trade Mark) Model 7447 dryer set to its full heat setting; the duration of the drying cycle was 60 minutes.

Eight batches were used, of which five (Examples 1 to 5) were treated with devices as described above with reference to FIGS. 1 to 4 of the accompanying drawings. The inner container in each case was a heat-sealed sachet approximately 6 cm×8 cm of Crompton (Trade Mark) 65031 AB tea bag paper, and the outer container was a slitted polypropylene sphere. Each sachet contained Arosurf (Trade Mark) TA 100 powder having a particle size of 180 to 250 μm in an amount ranging from 0.75 to 12.0 g.

The three remaining batches (Comparative Examples A to C) were used as controls. One (A) had been treated in the rinse with the recommended dose of a commercially available rinse conditioner (Comfort (Trade Mark) ex Lever Brothers Ltd); one (B) was tumble-dried with a commercially available impregnated tissue approximately 23×28 cm in size, containing about 3 g of a waxy solid fabric conditioner (Bounce (Trade Mark) ex Procter & Gamble); and the third (C) was tumble-dried without a fabric conditioner in any form.

After drying, the softness of pieces of terry towelling from the various batches were compared by a panel of four judges, and the results of the comparisons were processed statistically and normalised onto an arbitrary scale on which the softest samples (those treated with rinse conditioner) were assigned the score of 3.0 and the harshest samples (those untreated at any stage with conditioner) were assigned the score of 7.5.

The results were as follows:

| Example | Conditioning system | Conditioner delivered (g) | Harshness score |
|---|---|---|---|
| 1 | Sphere + sachet as described with reference to the drawings | 0.75 | 6.9 |
| 2 | | 1.50 | 6.8 |
| 3 | | 3.00 | 5.6 |
| 4 | | 6.00 | 5.1 |
| 5 | | 12.00 | 2.3 |
| A | Rinse conditioner | (Delivered from solution) | 3.0 |
| B | Impregnated tissue | 0.50 | 7.3 |
| C | None | 0 | 7.5 |

It will be noted that even with the lowest dose of conditioning agent (0.75 g), the device of the invention gives better softening than the impregnated tissue. The latter in fact gives little more softening than the tumble-drying process itself.

With a large dose of conditioning agent (12 g), the device of the invention can deliver greater softening than the rinse conditioner.

EXAMPLE 6

The following experiment was carried out in order to demonstrate the effectiveness of the device of the invention against the build-up of electrostatic charge.

Four mixed loads of cotton and synthetic fabric articles were washed in a Miele (Trade Mark) 429 automatic washing machine, using the recommended dose of Persil Automatic powder; the wash cycle terminated with spin drying.

The loads were then dried in a Bendix Model 7447 tumble-dryer set to its full heat setting; the duration of the drying cycle was 60 minutes.

The first load was dried without the addition of any form of conditioning agent. When the load was removed from the dryer at the end of the cycle the synthetic fabric articles clung to each other and were charged with static electricity; crackling and sparking occurred when the articles were pulled apart.

The second, third, and fourth loads were each dried together with a device as described above with reference to FIGS. 1 to 4 of the accompanying drawings, the devices containing respectively 1.0, 1.5 and 3 g of Arosurf powder. No clinging or static electricity was observed when the dry load was removed from the dryer.

I claim:

1. A device for conditioning fabrics in a tumble dryer, which device comprises a fabric conditioning composition in free-flowing powder form disposed within a sachet or flexible sheet material having at least one wall area permeable to said composition in powder form, the sachet being disposed within an outer container having openings for the egress of said composition in powder form, the outer container being substantially form-retaining and of a shape such as to allow ready tumbling thereof among the fabrics in a dryer, and the sachet being removable and replaceable.

2. The device of claim 1, wherein the second container is of a size such that its largest dimension is at least 6 cm.

3. The device of claim 1, wherein the second container comprises plastics material.

4. The device of claim 3, wherein the second container is of thermoplastic material having a softening point above 130° C.

5. The device of claim 3, wherein the second container is of polypropylene or high-density polyethylene.

6. The device of claim 1, wherein the second container comprises paper or board.

7. The device of claim 1, wherein the shape of the second container is such that the ratio of its principal axes (major to minor) is less than 3:1.

8. The device of claim 7, wherein the shape of the second container is such that the ratio of its principal axes (major to minor) is approximately 1:1.

9. The device of claim 1, wherein the shape of the second container substantially approximates to a shape selected from the group consisting of a sphere, a spheroid, an ellipsoid, a cylinder, a frustocone, a cube, two abutting frustocones and a hexagonal prism.

10. The device of claim 1, wherein the second container is separable into two or more separate, joined or integral parts whereby the first container can be removed or inserted.

11. The device of claim 1, wherein an aperture of the second container is enlargeable by flexure whereby the first container can be removed or inserted, the second container being of single piece construction.

12. The device of claim 1, wherein the first container is a sachet of paper, nonwoven fabric, plastics film or a laminate of any two or more of said materials.

13. The device of claim 1, wherein the first container is provided with an outer covering impermeable to the powdered fabric conditioning composition, the outer covering being in intimate contact with any surface region of the first container permeable to the fabric conditioning composition.

14. The device of claim 13, wherein the first container is a sachet of paper or nonwoven fabric permeable to the powdered fabric conditioner over part or whole of its area, and the outer covering comprises metal foil laminated to said paper or nonwoven fabric, at least part of said metal foil being readily removable to expose a permeable area of said paper or nonwoven fabric.

15. The device of claim 13, wherein the first container is a sachet of plastics film having paper or nonwoven fabric laminated thereto on its outermost side and having a plurality of openings for the passage of powdered fabric conditioner, and the outer covering comprises one or more pieces of paper coated with pressure-sensitive adhesive positioned so as to cover and close said openings.

16. The device of claim 1, wherein the fabric conditioning composition has a particle size range within the range of from 20 to 100 μm.

17. The device of claim 16, wherein the fabric conditioning composition has a particle size range within the range of 70 to 500 μm.

18. The device of claim 16, wherein the fabric conditioning composition has a particle size range within the range of from 90 to 250 μm.

19. The device of claim 1, wherein the fabric conditioning composition comprises a cationic and/or nonionic fabric conditioning agent.

20. The device of claim 19, wherein the fabric conditioning composition comprises a fabric-softening quaternary ammonium salt.

21. The device of claim 19, wherein the fabric conditioning composition includes distearyl dimethyl ammonium chloride.

22. The device of claim 1, wherein the first container contains from 0.5 to 12 g of the fabric conditioning composition.

23. The device of claim 22, wherein the first container contains from 1.5 to 10 g of the fabric conditioning composition.

24. The device of claim 22, wherein the first container contains from 2 to 7 g of the fabric conditioning composition.

* * * * *